United States Patent [19]

Bizard

[11] Patent Number: 4,523,634

[45] Date of Patent: Jun. 18, 1985

[54] DEVICES FOR SEPARATING THE CLEANING BODIES OF TUBE EXCHANGERS FROM THE FLUIDS WHICH TRANSPORT THEM

[75] Inventor: André Bizard, Paris, France

[73] Assignee: Societe En Nom Collectif, Paris, France

[21] Appl. No.: 497,718

[22] Filed: May 24, 1983

[30] Foreign Application Priority Data

Jun. 9, 1982 [FR] France ..... 82 10055

[51] Int. Cl.[3] ..... F28G 13/00; B01D 35/02

[52] U.S. Cl. ..... 165/95; 15/3.51

[58] Field of Search ..... 165/95; 15/3.5, 3.51; 210/353, 391, 396

[56] References Cited

U.S. PATENT DOCUMENTS

| | | | |
|---|---|---|---|
| 386,978 | 7/1888 | Gran | 165/95 |
| 1,378,715 | 5/1921 | Nielsen et al. | 165/95 |
| 4,079,782 | 3/1978 | Soderberg | 165/95 |
| 4,237,962 | 12/1980 | Vanderhoeck | 15/3.51 |
| 4,283,807 | 8/1981 | Bizard | 165/95 |
| 4,304,295 | 12/1981 | Otake | 15/3.51 |
| 4,314,604 | 2/1982 | Koller | 15/3.51 |
| 4,351,387 | 9/1982 | Milia | 15/3.51 |
| 4,366,855 | 1/1983 | Spitz | 165/95 |
| 4,385,660 | 5/1983 | Koller | 15/3.51 |

FOREIGN PATENT DOCUMENTS

| | | | |
|---|---|---|---|
| 26261 | 8/1979 | European Pat. Off. | 165/95 |
| 2818006 | 8/1979 | Fed. Rep. of Germany | 165/95 |
| 2822642 | 8/1979 | Fed. Rep. of Germany | 165/95 |
| 6128 | of 1904 | United Kingdom | 165/95 |

*Primary Examiner*—William R. Cline
*Assistant Examiner*—John J. McGlew, Jr.
*Attorney, Agent, or Firm*—Larson and Taylor

[57] ABSTRACT

The invention relates to a device for separating, from the fluid (F) which transports them, the cleaning bodies (2) leaving the tubes of an exchanger with this fluid after having cleaned these tubes, which device comprises two stages for gathering together the bodies respectively in two transverse direction X and Y perpendicular to each other, namely a first stage formed by an oblique grid (4) and a second stage formed by a hopper (6) converging toward the downstream direction, which hopper has a permeable wall (7) parallel to direction Y and is elongate in this direction. A bridge (9) is provided across the hopper, which bridge extends on each side of this hopper in direction X, but not in direction Y, which creates in the downstream region of the hopper swirls preventing any clogging up of the wall (7).

14 Claims, 11 Drawing Figures

Fig.1.
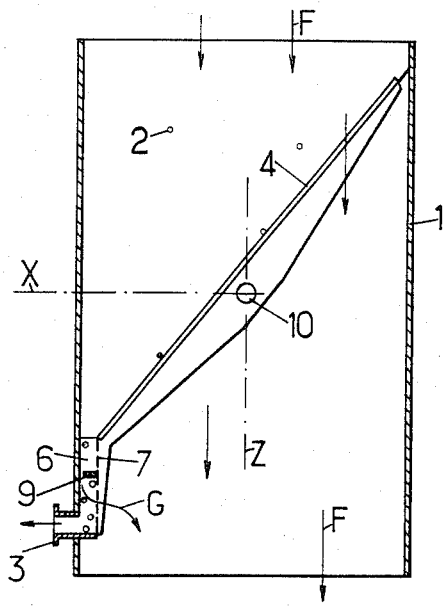
Fig.3.
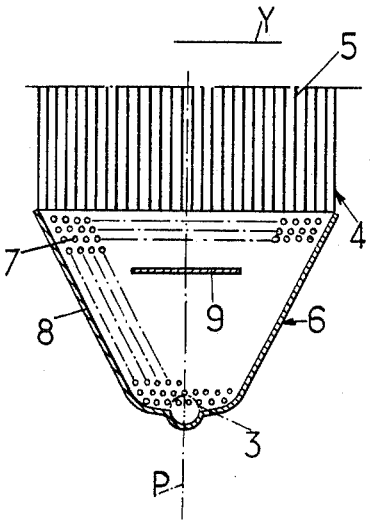
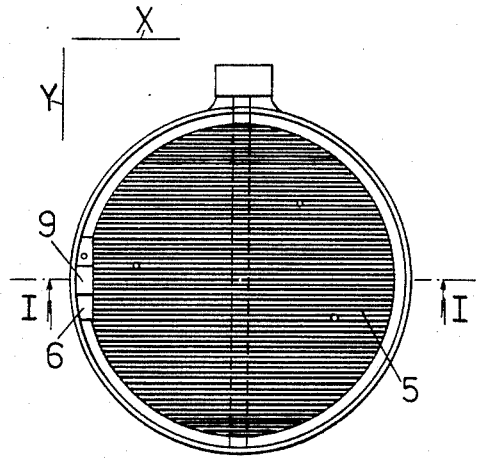
Fig.2.
Fig.4.
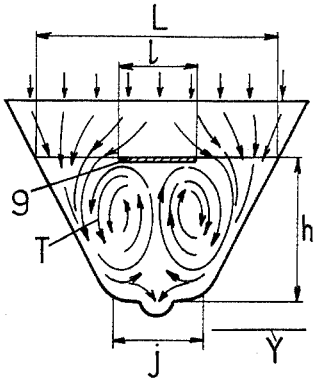

DEVICES FOR SEPARATING THE CLEANING BODIES OF TUBE EXCHANGERS FROM THE FLUIDS WHICH TRANSPORT THEM

FIELD OF THE INVENTION

The present invention relates to installations for exchanging heat between two fluids, which installations comprise a tube exchanger, especially of the condenser type, and in which the tubes are cleaned on the inside by means of solid bodies, generally spherical and resilient, carried along in these tubes by the fluid which flows therein.

BACKGROUND OF THE INVENTION

The present invention relates more particularly to the devices for separating cleaning bodies from the fluid which transports the cleaning bodies after they exit from the tubes, particularly where the cleaning bodies are recycled back to the inputs of the tubes. These devices comprise two successive separator stages with a grid or the like mounted in a section of the output duct of the exchanger and a collector connected to the outlet of the second separator stage and arranged so as to receive the cleaning bodies separated from the main current of the fluid and to remove them from the duct. The collector is generally formed by the suction nozzle(s) of a recycling pump.

The two separator stages are intended to gather together the cleaning bodies along respectively two transverse directions X and Y, perpendicular to each other, of the duct section in question which has a longitudinal axis Z.

The first of these stages, or upstream stage, comprises at least one grid formed of parallel equidistant bars whose spacing apart is less than the smallest overall dimension of the cleaning bodies, this grid being mounted obliquely across the duct section in question with its bars parallel to the plane containing the direction X and the axis Z of this section, such that the fluid flows through said grid but the cleaning bodies are stopped by it and are guided along its bars as far as its downstream end while being deviated or deflected thereby in direction X.

The second stage, or downstream stage, is in the general form of a relatively flat hopper converging in the downstream direction and in direction Y, which hopper is mounted so as to receive the cleaning bodies coming from the downstream end of the first stage, the cross section of this hopper being elongate in direction Y, at least one of its walls extending in this direction Y being permeable to the fluid but not to the cleaning bodies and at least one of its walls extending parallel to direction X forming a deflector adapted to deflect the cleaning bodies in direction Y as far as the downstream collector.

The two separator stages which have just been defined may be clearly distinct from each other.

But they may also merge with each other continuously, the permeable wall of the hopper which forms the second stage being for example formed by the downstream extension of a grid forming the first stage, this extension being possibly even connected to the rest of the grid by a curved zone free of sharp angles.

When the fluid flowing through the separation devices contains a large number of impurities, (such as shells, wood debris and the like) having dimensions close to those of the cleaning bodies, these impurities, which are directed along with the cleaning bodies by the grid of the first stage into the hopper of the second stage may, under certain conditions, collection the permeable wall of this hopper and clog it up.

This clogging reduces the fluid flow through said wall, which reduces correspondingly the force sucking the cleaning bodies into the hopper in the direction of the collector.

This reduction in fluid flow may end up as a complete stoppage of the flow and in the accumulation of the cleaning bodies upstream of said hopper or at least upstream of said collector, which defeats the purpose of the desired separation.

It so happens in fact that the normal flow of the fluid through the permeable wall of the hopper exercises a preponderant role for carrying these bodies towards the collector, the flow in question being higher than the residual flow of the fluid which accompanies the cleaning bodies into the collector, the first being of the order of 20 times higher than the second.

To overcome this serious drawback, it has already been proposed to clean the permeable wall of the hopper periodically, more particularly by temporarily reversing the direction of fluid flow through this wall.

SUMMARY OF THE INVENTION

The aim of the invention is to provide other particularly efficient and economic means for remedying the above-mentioned disadvantage of clogging up of the permeable wall of the hopper.

To this end, the separation devices of the kind in question are essentially characterized in that they comprise a bridge extending, across the channel defining the fluid current charged with cleaning bodies, at a level between the upstream regions of the two separator stages, these regions included, that is to say at the level of the inlet of the fluid current in question into the hopper or a little upstream of this level or else inside the hopper, from a wall of said channel as far as the opposite wall in direction X, but not in direction Y, the downstream collector being disposed so that its upstream orifice opens opposite one of the streams of the swirls created by the presence of said bridge in said current downstream of this bridge.

In preferred embodiments, recourse is further had to one and/or other of the following arrangements wherein:

the bridge is formed by a piece of metal sheet, flat or curved at least locally, in a separator in which the bridge is disposed inside the hopper, and the portion of the permeable wall of the hopper situated upstream of the bridge is solid, the permeable wall of the hopper is formed by a perforated metal sheet, preferably with the percentage of apertures or perforations to the overall surface being the order of 50%, the ratio between the dimensions l of the bridge in direction Y and the inner width L of the channel in this direction Y at the level of said bridge is between 0.2 and 0.9, preferably between 0.3 and 0.4, the distance, measured parallel to axis Z, between the bridge and the downstream bottom of the hopper is between 0.5 and 2 times the dimension l of this bridge in direction Y, the bridge is disposed in the middle of the inner width of the channel in direction Y, the cross section of the hopper through a plane perpendicular to the direction X has the form of an isosceles trapezoid, and the small base of this isosceles trapezoid is at least equal to half the dimension l of the bridge in direction Y, the hopper is asymmetrical and the bridge is adjacent not only the two walls of the hopper extending in direction Y but also one of its walls parallel to direction X, the bridge is fixed preferably by welding, to a permeable wall defining the channel, the bridge is fixed to the duct section, the upstream orifice of the collector opens just downstream of the bridge.

The invention comprises, apart from these main arrangements, certain other arrangements which are used preferably at the same time and which will be more explicitly discussed hereafter.

BRIEF DESCRIPTION OF THE DRAWINGS

In what follows, preferred embodiments of the invention will be described with reference to the accompanying drawings in a way which is of course in no way limiting.

FIGS. 1 and 2 of these drawings show respectively in axial section along I—I of FIG. 2 and in an axial view a separator device constructed in accordance with the invention.

FIG. 3 shows an enlarged side view of the downstream portion of a component of the separator device.

FIG. 4 is an explanatory view similar to that of FIG. 3.

DESCRIPTION OF THE PREFERRED EMBODIMENTS

Figure 6:
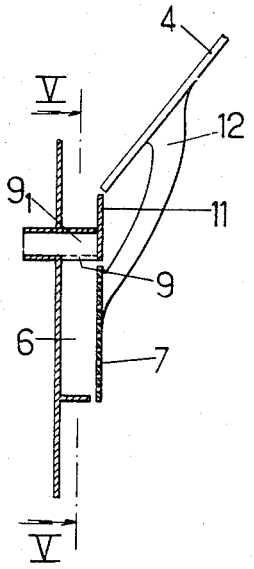
FIGS. 5 and 6 show respectively in lateral section along V—V of FIG. 6 and in axial section along VI—VI of FIG. 5, the downstream portion of another separator device in accordance with the invention.

In each embodiment of the invention, the separator is mounted across a duct section 1 with axis Z in which the fluid leaving a tube heat exchanger flows, which fluid is shown schematically by arrows F.

This fluid takes with it cleaning bodies 2 formed preferably, but not necessarily, by balls of a resilient material whose diameter is slightly greater than that of the tubes to be cleaned.

In a way known per se, the separator comprises two stages for gathering together respectively the cleaning bodies 2 in two transverse directions X and Y perpendicular to each other so as to separate the majority of the cleaning bodies from the carrier fluid current and to discharge them into the upstream orifice of a collector 3 external to the duct, which orifice is formed by the suction nozzle(s) of a recycling pump.

The first stage of the separator, i.e., the upstream stage, comprises at least one grid 4 disposed obliquely with respect to axis Z so as to let pass therethrough the fluid F but not the bodies 2.

This grid 4 is formed of parallel equidistant bars 5 whose mutual spacing is less than the largest overall dimension of bodies 2.

These bars 5 extend parallel to the line having the largest slope of the grid, which line is itself contained in plane P which contains axis Z and direction X.

On reaching the grid 4, the bodies 2 carried along axially by the fluid F are diverted transversely by this grid in direction X and are guided by sliding along bars 5 as far as the downstream end of the grid.

The second stage of the separator, i.e., the downstream stage, is formed by a flat hopper 6 converging downstream and in direction Y.

This hopper 6 is arranged and disposed so as to receive automatically the cleaning bodies delivered by the downstream end of grid 4.

Hopper 6 is, generally rectangular in shape, and is elongate in direction Y.

At least one of the walls 7 of hopper 6 extending in this direction Y is permeable to fluid F but not to the cleaning bodies 2: here the second wall 7 is formed by a part of the duct section 1 itself.

At least one of two lateral walls 8 of the hopper 6, which extend parallel to direction X, forms a solid deflector adapted to divert bodies 2 along direction Y as far as the downstream end of the hopper, in the instances where two walls 8 are provided 8.

It is in said hopper 6 into which opens the suction orifice of collector 3. To remove any risks of clogging up of the permeable wall 7, in accordance with the invention, there is provided in the hopper a small bridge 9 connecting together the opposite walls of this hopper in direction X, but not in direction Y.

This bridge is then disposed across the main current of fluid F, tending to penetrate normally into the hopper, and which directs a portion of this current in direction Y, but not in direction X.

The whole of this current, charged with cleaning bodies 2 and possibly impurities, penetrates then "tangentially" into the confined volume, converging in the downstream direction, which forms the downstream portion of the hopper, namely, the portion disposed downstream of bridge 9.

This current is subjected to a violent swirling movement in said downstream portion, as shown at T in FIG. 4 The flow of said current inside said confined volume is limited to this flow pattern before the largest part of the carrier fluid F forming this current is discharged through the permeable wall 7, i.e. perpendicularly to the plane of the swirl (arrow G, FIG. 1).

Experience shows that it is sufficient to dispose the upstream orifice of the suction collector 3 in the immediate vicinity of one of the swirling streams T to enable the cleaning bodies and other impurities, which are conveyed by these streams, and which are too large to pass through wall 7, to be removed automatically and rapidly towards this collector.

This surprising result, obtained by the simple addition of the above-described bridge across the hopper, presents a very great advantage in practice, i.e., the practically complete removal of all the risks of clogging of the permeable wall which have been previously mentioned. This considerably reduces the extent and the frequency of the operations headed for cleaning this wall.

The general shape of the swirling movement imparted to the current of charged fluid in the downstream volume of the hopper is that of two swirls symmetrical to each other with respect to the above-defined plane P when, as is the preferred case, bridge 7 is disposed in the middle of the width of the hopper in direction Y and when this hopper is itself symmetrical with respect to plane P.

In this case, the two swirls, in a manner of speaking, bear laterally against each other along plane P.

Figure 9:
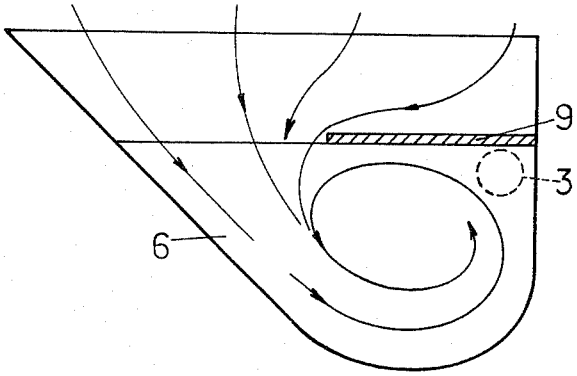
FIG. 9 shows schematically an asymmetrical variation of such a separator.

But an assymetrical hopper could also be provided such as the one shown schematically in FIG. 9. Such an assymetrical hopper may be derived from the preceding one by giving material shape to the above mentioned plane P by means of a solid dividing wall in the downstream part of the hopper, each half of this downstream portion corresponding then to said assymetrical hopper. In this latter case, the bridge is adjacent not only the two walls of the hopper parallel to direction Y but also to one of the walls of this hopper parallel to direction X.

The bridge is generally formed by a piece of flat metal sheet possibly comprising a portion bent or curved, generally at its center.

The width of this bridge in direction X is that of the hopper.

But this bridge is not necessarily integral with the two walls which it connects together.

This is in particular the case when the separator is pivotably mounted about a transverse axis 10 parallel to direction Y, so that its slant may be temporarily reversed with respect to the flow direction of fluid F for cleaning purposes.

In such a case, the bridge may be fixed, especially by welding, to the permeable wall 7 from which it projects perpendicularly: this is what is illustrated in FIGS. 1 to 4.

Figure 5:
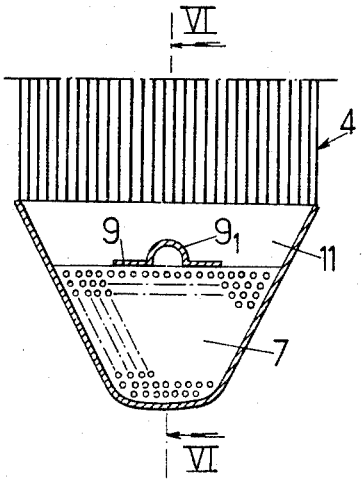

In a variation of the same embodiment, the bridge is fixed to the duct section 1: such a variation is shown in FIGS. 5 and 6, where the upstream orifice of the collector 3 opens just downstream of bridge 9. In this variation, the central portion $9_1$ of the bridge has a semi-circular section open in the downstream direction and forms the upstream section of collector 3.

It may be advantageous to form, by means of a solid dividing wall, the portion 11 of permeable wall 7 which is situated upstream of the bridge.

The embodiment of FIGS. 5 and 6 lends itself well to such an arrangement, the solid portion 11 being then possibly made integral with section $9_1$ and a frame 12 being then provided to firmly secure together grid 4 and the permeable wall 7 of hopper 6.

The width of bridge 9 in direction Y is a fraction of the width L of the hopper in this direction at the level of this bridge (see FIG. 4).

This fraction is preferably between 0.3 and 0.4 and is more generally between 0.2 and 0.9: for values less than 0.2, the bridge would be too narrow and the swirls would only extend over too small a part of the volume of the hopper situated downstream of this bridge; for values greater than 0.9, the flow of fluid charged with cleaning bodies reaching said downstream volume of the hopper would be too small with respect to the size of the swirls and these latter would lack strength.

In practice, width L is generally between 20 and 60 cm.

If we call h the distance, reckoned parallel to axis Z, between bridge 9 and the bottom of the hopper, this distance h is advantageously between 0.5 l and 2l, an advantageous value being 1.2 l.

The bottom of this hopper has itself preferably a certain width, which gives it a trapezoidal and not a triangular shape: this width j is in general between 0.5 l and L, and preferably of the same order of size as l if the width is equal to the value of L, the downstream portion of the hopper has a rectangular longitudinal section which is not very interesting in itself but which provides, in operation, that the two downstream corners of such a hopper fill up with cleaning bodies and/or impurities, that are not discharged towards the collector, and the surfaces of the piles of bodies and impurities accumulated in these corners define a free inner volume of trapezoidal shape exhibiting a good extraction efficiency, i.e., high efficiency in extracting the cleaning bodies from the carrier fluid.

The permeable wall 7 may be formed by a grid, this grid being possibly the downstream end of grid 4 bent back for this purpose parallel to axis Z.

In preferred embodiments, said permeable wall is formed by a perforated metal sheet having a relatively large ratio of apertures to overall surface area, for example equal to 50%.

Figure 7:
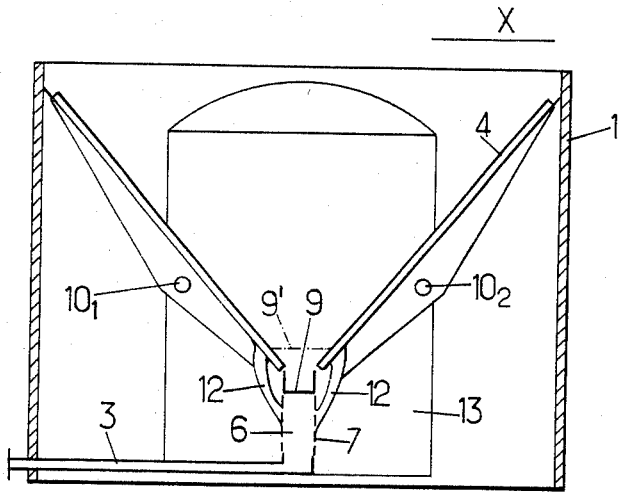
FIGS. 7 and 8 show respectively in axial section along two directions perpendicular to each other yet another separator device according to the invention.
Figure 8:
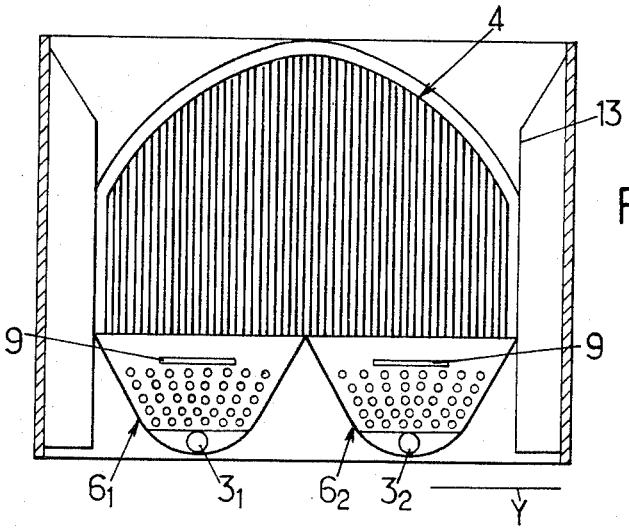

The embodiment of FIGS. 7 and 8 differs from the preceding ones in that the separator housed in the duct section 1 is broken up into two elementary separators symmetrical to one another with respect to an axial plane parallel to direction Y and in which the first stages gather the cleaning bodies together, in direction X, not towards the lateral wall of section 1 but towards the axis of this section.

The hoppers forming the second stages of these two separators are then combined in a single central hopper 6 whose walls 7, parallel to direction Y, are both apertured.

In the drawings, this hopper is formed by two elementary hoppers $6_1$, $6_2$ (see FIG. 8) disposed side by side in direction Y, and connected respectively to two upstream offtakes $3_1$, $3_2$ of collector 3; this construction considerably reduces the axial dimension of the hoppers.

There can be further seen in these FIGS. 7 and 8:

frames 12 fulfilling exactly the same role as frame 12 illustrated in FIG. 6, lateral caissons 13 mounted in section 1 and defined in this section by flat longitudinal walls determining the volume accessible to fluid F in the center of section 1 so as to make it possible, without lateral play, to rock the separators about their transverse rotational axes $10_1$, $10_2$ for cleaning purposes.

Figure 10:
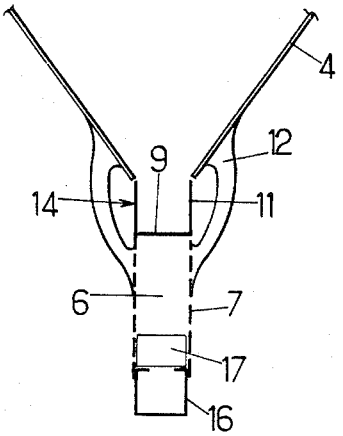
FIGS. 10 and 11 show respectively in axial section along two directions perpendicular to each other yet another separator device in accordance with the invention.
Figure 11:
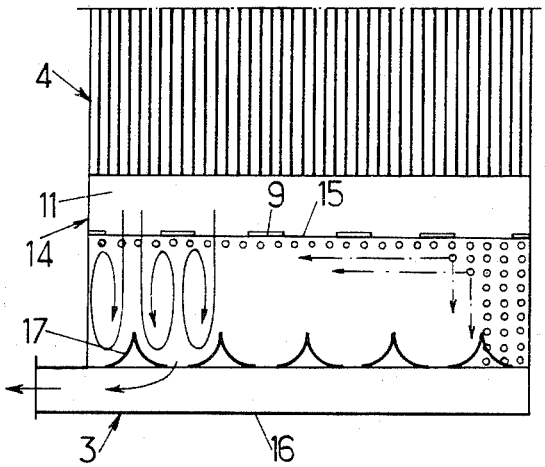

FIGS. 10 and 11 show schematically a simplified embodiment of the split construction which has just been described with reference to FIGS. 7 and 8.

In this variation, hopper 6 is again in the center of section 1, but it is further broken up into more than two elementary hoppers juxtaposed side by side in direction Y. In FIG. 11 the number of elementary hoppers is equal to 4, with two assymetrical elementary half-hoppers of the kind illustrated in FIG. 9 being further provided at the two transverse ends of the row.

In this case, the different solid upstream portions 11 of the hoppers and the different bridges 9 are formed by one and the same U section 14 with sharp edges open towards the upstream direction and having a flat bottom apertured at 15.

The upstream section of collector 3 is also formed by such a U shaped section 16 open towards the upstream direction, this upstream opening being partially closed by a succession of covers 17.

The different covers 17, disposed opposite openings 15, define the bottoms of the above different elementary hoppers and are each formed by two pieces of flat metal sheet each curved along a quarter of a cylinder of revolution and are joined together side by side so as to form a kind of circumflex accent (see FIG. 11).

Following which, and independent of the embodiment adopted, a separator is provided of the above-described kind whose construction, operation and advantages, particularly the automatic suppression of any risk of the permeable downstream wall being clogged up, follow sufficiently from what has gone before.

As is evident, and as it follows already moreover from what has gone before, the invention is not limited to those of its modes of application and embodiments which have been more especially considered; it embraces, on the contrary, all variations thereof, particularly:

those where the above-defined distance h between the bridge and the bottom of the hopper is not less than the axial direction of the hopper but equal to or greater than this dimension, the bridge 9 being in this latter case placed a little upstream of the transmission zone connecting together the two stages of the separator, as is shown schematically at 9' in FIG. 7, the level where said bridge is located being thus able to be generally defined as "between the upstream regions of the two separator stages, including these regions", those where the piece of metal sheet or plate forming the bridge is curved over the whole of its extent like a Roman tile with the convex curve facing in the upstream direction or else bent in a dihedron having its point directed upstream, the two sides of this dihedron being possibly curved with their concavity oriented more especially upstream so as to guide the fluid just upstream of this bridge, those where the bridge is formed by an element other than a piece of metal sheet or plate, for example by a hollow or solid prism having in cross section the form, for example, of a curvilinear triangle one rectilinear side of which extends transversely with respect to the general flow direction of the fluid upstream of the bridge and whose other sides extend obliquely with respect to this general direction. The oblique sides are preferably curved with the concave side facing upstream or else by a hollow or solid half-tube with the convex side facing upstream, the diametrical opening of this half-tube, orientated downstream, and advantageously being itself closed by means of a flat panel, and those where the downstream face of the bridge is itself formed so as to guide the swirl(s) along this face and includes for this purpose, in the case of a symmetrical hopper, a projection in the form of a dihedron, with flat or curvilinear sides.

I claim:

1. A device for separating cleaning bodies exiting from a tube type heat exchanger from a fluid which carries the cleaning bodies after the bodies have served in cleaning the tubes of the heat exchanger, said device comprising first and second successive separator stages including a grid mounted in a duct section having a longitudinal axis Z, connected to the outlet of the heat exchanger and intended to gather together the cleaning bodies in two directions X and Y which are perpendicular to each other and transverse to said duct section, and a collector connected to the output of the second separator stage and arranged to receive the cleaning bodies separated from the main current of the fluid and to discharge the cleaning bodies from the duct, said grid being located in said first stage and being formed from parallel equispaced bars whose spacing is less than the smallest overall dimension of the cleaning bodies, said grid being mounted obliquely across the duct section with the bars thereof parallel to the plane containing the direction X and the axis Z of the duct section, so that the fluid passes through said grid but the cleaning bodies are stopped by the grid and are guided along the bars of the grid as far as the downstream end thereof while being deflected by the bars in direction X, the second stage comprising a hopper converging in the downstream direction and in the direction Y, said hopper being mounted so as to receive the cleaning bodies coming from the downstream end of the first stage, the cross section of said hopper being elongate in the direction Y, at least one of the walls of said hopper extending in the direction Y being permeable to the fluid and impermeable to the cleaning bodies, and at least one of the walls of the hopper extending parallel to the direction X forming a deflector for deflecting the cleaning bodies, in the direction Y, as far as the downstream collector, said deflector comprising a bridge extending across the channel defining the current of fluid charged with cleaning bodies, at a level between the downstream region of the two separator stages, these regions included, from a wall of said channel as far as the opposite wall in the direction X, but not in the direction Y, the bridge creating swirls in the fluid current downstream of the bridge and the downstream collector being disposed so that an upstream orifice thereof opens opposite one of the swirls created by the presence of said bridge in said current downstream of said bridge.

2. The separator according to claim 1, characterized in that the bridge is formed by a piece of metal sheet.

3. The separator according to claim 1, characterized in that the ratio between the long dimension l of the bridge in the direction Y and the inner width L of the channel in this direction Y at the level of said bridge is between 0.2 and 0.9.

4. The separator according to claim 1, characterized in that the distance, measured parallel to the axis Z, between the bridge and the downstream bottom of the hopper is between 0.5 and 2 times the long dimension l of said bridge in the direction Y.

5. The separator according to claim 1, characterized in that the bridge is disposed in the middle of the inner width of the channel in the direction Y, in that the cross section of the hopper in a plane perpendicular to the direction X has the general shape of an isosceles trapezoid and in that the small base of this said isosceles trapezoid is at least equal to half the long dimension l of the bridge in the direction Y.

6. The separator according to claim 1, characterized in that the hopper is assymetrical and in that the bridge is disposed adjacent to two walls of the hopper extending in the direction Y, and to one of the walls of the hopper extending parallel to the direction X.

7. The separator according to claim 1, characterized in that the bridge is fixed to a permeable wall defining the channel.

8. The separator according to claim 1, characterized in that the bridge is fixed to the duct section.

9. The separator according to claim 8, in which the first stage comprises two grids which are symmetrical with respect to an axial plane parallel to the direction Y and which gather together the cleaning bodies towards said hopper, said hopper being centrally located and being formed from a series of elementary hoppers juxtaposed side by side in the direction Y, a plurality of said bridges being provided one for each of said elementary hoppers, said bridges being formed by a flat apertured bottom of a common U section which opens towards the upstream direction.

10. The separator according to claim 1, characterized in that the upstream orifice of the collector opens just downstream of the bridge.

11. The separator according to claim 2, wherein said metal sheet is flat.

12. The separator according to claim 2, wherein said metal sheet is curved.

13. The separator according to claim 3, wherein said ratio is between 0.3 and 0.4.

14. A separator according to claim 7 wherein said bridge is welded to said permeable wall.

* * * * *

UNITED STATES PATENT AND TRADEMARK OFFICE

CERTIFICATE OF CORRECTION

PATENT NO. : 4,523,634

DATED : June 18, 1985

INVENTOR(S) : BIZARD, ANDRE

It is certified that error appears in the above-identified patent and that said Letters Patent is hereby corrected as shown below:

Title page, item [73] should read as follows:

[73] Assignee: Societe en nom collectif TECHNOS et Compagnie

Signed and Sealed this

*Twenty-fifth* Day of *February 1986*

[SEAL]

*Attest:*

DONALD J. QUIGG

*Attesting Officer*

*Commissioner of Patents and Trademarks*